US008861752B2

(12) United States Patent
Margalit

(10) Patent No.: US 8,861,752 B2
(45) Date of Patent: Oct. 14, 2014

(54) TECHNIQUES FOR GENERATING AUDIO SIGNALS

(75) Inventor: Mordehai Margalit, Zichron Yaaqov (IL)

(73) Assignee: Empire Technology Development LLC, Wilmington, DE (US)

( * ) Notice: Subject to any disclaimer, the term of this patent is extended or adjusted under 35 U.S.C. 154(b) by 416 days.

(21) Appl. No.: 13/390,337

(22) PCT Filed: Aug. 16, 2011

(86) PCT No.: PCT/US2011/047833

§ 371 (c)(1),
(2), (4) Date: Feb. 14, 2012

(87) PCT Pub. No.: WO2013/025199

PCT Pub. Date: Feb. 21, 2013

(65) Prior Publication Data

US 2013/0044904 A1 Feb. 21, 2013

(51) Int. Cl.
*H04R 25/00* (2006.01)
*H04R 1/00* (2006.01)

(52) U.S. Cl.
CPC ..... *H04R 1/00* (2013.01)
USPC ..... 381/152; 381/191; 381/431

(58) Field of Classification Search
USPC ..... 381/77, 79, 152, 160, 182, 186, 386, 381/387, 189, 190, 191, 431
See application file for complete search history.

(56) References Cited

U.S. PATENT DOCUMENTS

| | | | | |
|---|---|---|---|---|
| 5,889,870 | A * | 3/1999 | Norris | 381/77 |
| 6,315,462 | B1 | 11/2001 | Anthamatten et al. | |
| 6,388,359 | B1 | 5/2002 | Duelli et al. | |
| 6,584,205 | B1 | 6/2003 | Croft, III et al. | |
| 6,612,029 | B2 | 9/2003 | Behin et al. | |
| 6,678,381 | B1 | 1/2004 | Manabe | |
| 6,771,001 | B2 | 8/2004 | Mao et al. | |
| 6,778,672 | B2 | 8/2004 | Breed et al. | |
| 6,925,187 | B2 * | 8/2005 | Norris et al. | 381/191 |
| 7,747,029 | B2 | 6/2010 | Kim et al. | |
| 7,961,900 | B2 | 6/2011 | Zurek et al. | |
| 8,079,246 | B2 | 12/2011 | Garmire et al. | |

(Continued)

FOREIGN PATENT DOCUMENTS

| | | |
|---|---|---|
| EP | 2271129 A1 | 1/2011 |
| EP | 2381289 A1 | 10/2011 |

(Continued)

OTHER PUBLICATIONS

Brett M. Diamond, "Digital Sound Reconstruction Using Arrays of CMOS-MEMS Microspeakers," 2002, pp. 1-60, Electrical and Computer Engineering, CarnegieMellon University.

(Continued)

*Primary Examiner* — Huyen D Le
(74) *Attorney, Agent, or Firm* — Ren-Sheng International

(57) ABSTRACT

Techniques described herein generally relate to generating an audio signal with a speaker. In some examples, a speaker device is described that includes a membrane and a shutter. The membrane can be configured to oscillate along a first directional path and at a first frequency effective to generate an ultrasonic acoustic signal. The shutter can be positioned about the membrane and configured to modulate the ultrasonic acoustic signal such that an audio signal can be generated.

21 Claims, 7 Drawing Sheets

(56) References Cited

U.S. PATENT DOCUMENTS

| | | | |
|---|---|---|---|
| 8,428,278 | B2 | 4/2013 | Lastrucci |
| 2006/0291667 | A1 | 12/2006 | Watanabe et al. |
| 2008/0205195 | A1 | 8/2008 | Van Der Merwe et al. |
| 2008/0285777 | A1 | 11/2008 | Pompei |
| 2010/0080409 | A1 | 4/2010 | Xu et al. |
| 2010/0264777 | A1 | 10/2010 | Medhat et al. |
| 2010/0289717 | A1 | 11/2010 | Arslan et al. |
| 2013/0044904 | A1 | 2/2013 | Margalit |

FOREIGN PATENT DOCUMENTS

| | | | |
|---|---|---|---|
| JP | 2007312019 | A | 11/2007 |
| WO | 9812589 | A2 | 3/1998 |
| WO | 0173934 | A2 | 10/2001 |

OTHER PUBLICATIONS

Masahide Yoneyama et al., "The Audio Spotlight: An Application of Nonlinear Interaction of Sound Waves to a New Type of Loudspeaker Design," Journal of the Acoustical Society of America, May 1983, pp. 1532-1536, J. Acoust. Soc. Am. 73 (5).

Notification of Transmittal of the International Search Report and the Written Opinion of the International Searching Authority, Aug. 3, 2011.

http://www.me.gatech.edu/mist/cmut.htm, retrieved/printed on Nov. 30, 2011.

http://en.wikipedia.org/wiki/Electrostatic_loudspeaker, retrieved/printed on Feb. 3, 2012.

"Single-sideband modulation", Wikipedia, <retrieved on Feb. 28, 2014>, Retrieved from the Internet at <URL: http://web.archive.org/web/20130615153848/> for <http://en.wikipedia.org/wiki/Single-sideband_modulation>, Last modified on Jun 14, 2013.

"Hilbert transform", Wikipedia, <retrieved on Feb. 28, 2014>, Retrieved from the Internet at < URL: http://web.archive.org/web/20100419005913/> for <http://en.wikipedia.org/wiki/Hilbert_transform>, Last modified on Apr. 18, 2010.

Mohammad Olfatnia et al., "Large Stroke Electrostatic Comb-Drive Actuators Enabled by a Novel Flexure Mechanism", Journal of Microelectromechanical Systems, Apr. 2013, pp. 483-494, vol. 22, No. 2, IEEE (2012).

Rob Legtenberg et al., "Comb-drive actuators for large displacements", J. Micromech, Microeng, Jun. 4, 1996, pp. 320-329, vol. 6, IOP Publishing Ltd.

Tristan T. Trutna et al., "An Enhanced Stability Model for Electrostatic Comb-Drive Actuator Design", Proceedings of the ASME 2010 International Design Engineering Technical Conferences & Computers and Information in Engineering Conference, Aug. 15-18, 2010, pp. 1-9.

Brian D. Jensen et al., "Shaped Comb Fingers for Tailored Electromechanical Restoring Force", Journal of Microelectromechanical Systems, Jun. 2003, pp. 373-383, vol. 12, No. 3.

"Microelectromechanical Systems", Wikipedia, <retrieved on Mar. 25, 2014>, Retrieved from the Internet at < URL: http://web.archive.org/web/20130116072616/http://en.wikipedia.org/wiki/Microelectromechanical_systems>, Last modified on Jan. 7, 2013.

Anatol Khilo et al., "Broadband Linearized Silicon Modulator", Optics Express, Feb. 28, 2011, pp. 4485-4500, Vo. 19, No. 5, Optical Society of America (2011) It can also retrieved from <URL: http://nanophotonics.labs.masdar.ac.ae/pdf_anatoly/Khilo-Linearized_Si_Modulator-OE11.pdf>.

Alexander A Trusov et al., "Capacitive Detection in Resonant MEMS With Arbitrary Amplitude of Motion", J. Micromech. Microeng, Jul. 13, 2007, pp. 1583-1592, vol. 17, IOP Publishing Ltd.

"Sound from ultrasound", Wikipedia, <retrieved on Feb 28, 2014>, Retrieved from the Internet at <URL:http://web.archive.org/web/20130829134301/http://en.wikipedia.org/wiki/Sound_from_ultrasound>, Last modified on Jun. 27, 2013.

"Discover the remarkable novel way to transmit sound", Parametric Sound, 2012, <retrieved on Feb. 28, 2014>, Retrieved from the Internet at <URL:http://web.archive.org/web/20120812003216/http://www.parametricsound.com/Technology.php>.

M. Olfatnia et al., "Note: An Asymmetric Flexure Mechanism for Comb-Drive Actuators", Review of Scientific Instruments, 2012, pp. 116105-1~116105-3, vol. 83, American Institute of Physics.

Wenjing Ye et al., "Optimal Shape Design of an Electrostatic Comb Drive in Microelectromechanical Systems", Journal of Microelectromechanical Systems, Mar. 1998, pp. 16-26, vol. 7, No. 1.

C. Nguyen, "MEMS Comb-Drive Actuators", Microfabrication Technology, Spring 2010, retrieved from the Internet at <URL: http://inst.eecs.berkeley.edu/~ee143/sp10/labs/MEMS.combdrive.ee143.s10.v0.pdf>.

* cited by examiner

TECHNIQUES FOR GENERATING AUDIO SIGNALS

CROSS REFERENCE TO RELATED APPLICATION

The present application is a 371 application of International Application PCT/US2011/047833, filed on Aug. 16, 2011 and entitled "TECHNIQUES FOR GENERATING AUDIO SIGNALS." The International Application, including any appendices or attachments thereof, is hereby incorporated by reference in its entirety.

TECHNICAL FIELD

The present disclosure generally relates to techniques for generating an audio signal and in some examples to methods and apparatuses for generating an audio signal on mobile devices.

BACKGROUND OF THE DISCLOSURE

A speaker is a device that generates acoustic signals. A speaker usually includes an electromagnetically actuated piston which creates a local pressure in the air. The pressure transverses the medium as an acoustic signal and is interpreted by an ear to register as sound.

SUMMARY

Some embodiments of the present disclosure may generally relate to a speaker device that includes a membrane and a shutter. The membrane is positioned in a first plane and configured to oscillate along a first directional path and at a first frequency effective to generate an ultrasonic acoustic signal. The shutter is positioned in a second plane that is substantially separated from the first plane. The shutter is configured to modulate the ultrasonic acoustic signal such that an audio signal is generated.

Other embodiments of the present disclosure may generally relate to a speaker array. The speaker array may include a first speaker and a second speaker. The first speaker includes a first membrane and a first shutter. The second speaker includes a second membrane and a second shutter. The first membrane may be configured to oscillate in a first directional path and at a first frequency effective to generate a first ultrasonic acoustic signal. The first shutter may be positioned above the first membrane and configured to modulate the first ultrasonic acoustic signal such that a first audio signal is generated. The second membrane may be configured to oscillate in the first directional path and at a second frequency effective to generate a second ultrasonic acoustic signal. The second shutter may be positioned above the second membrane and configured to modulate the second ultrasonic acoustic signal such that a second audio signal is generated.

Additional embodiments of the present disclosure may generally relate to methods for generating an audio signal. One example method may include selectively oscillating a membrane located in a first plane along a first directional path and at a first frequency effective to generate an ultrasonic acoustic signal and selectively moving a shutter positioned in a second plane that is separated from the first plane effective to modulate the ultrasonic acoustic signal and generate an audio signal.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are therefore not to be considered limiting of its scope, the disclosure will be described with additional specificity and detail through use of the accompanying drawings.

DETAILED DESCRIPTION

Figure 1A:
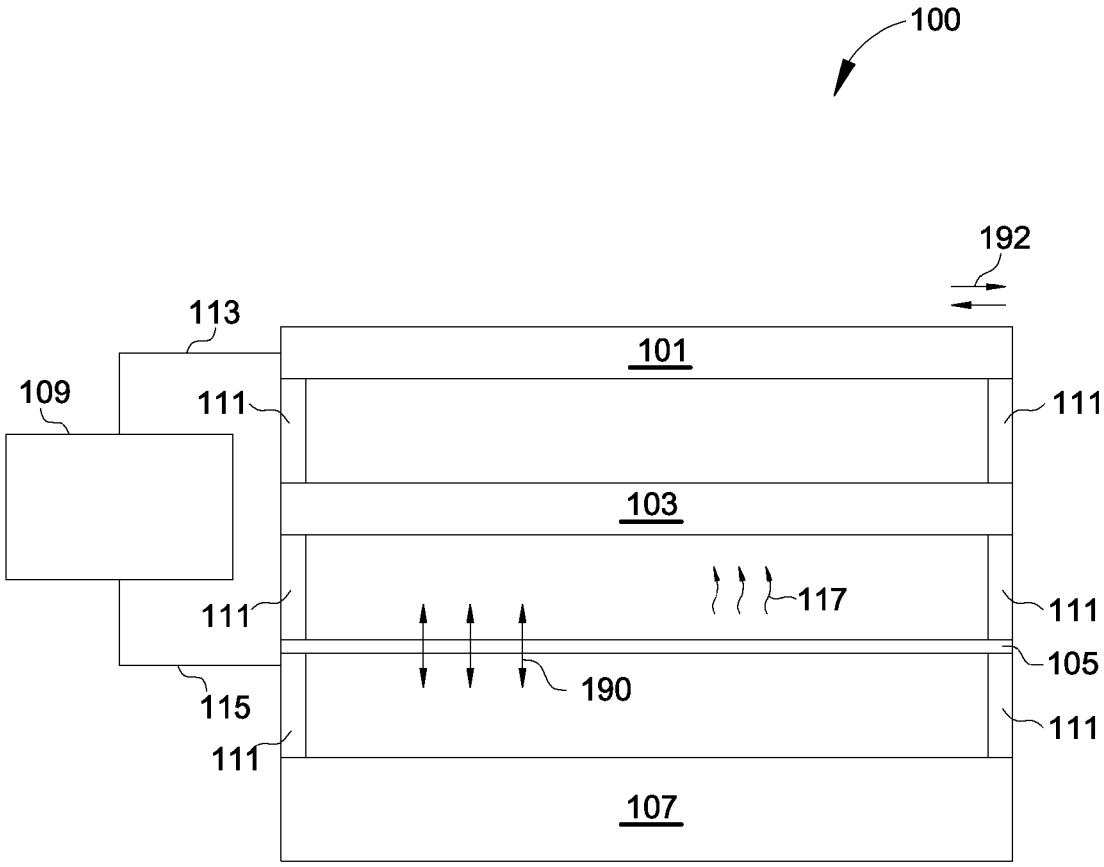
FIG. 1A is a cross sectional view of an illustrative embodiment of a speaker.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

This disclosure is drawn, inter alia, to methods, apparatus, computer programs, and systems of generating an audio signal.

In some embodiments, a speaker device is described that includes a membrane and a shutter. The membrane can be configured to oscillate along a first directional path and at a first frequency effective to generate an ultrasonic acoustic signal. The shutter is positioned proximate to the membrane. The speaker may further include a blind. The blind may be positioned between the membrane and the shutter, or alternatively positioned above the membrane and the shutter. The membrane, the blind, and the shutter may be positioned in a substantially parallel orientation with respect to each other.

The shutter can be configured to move along a second directional path that is substantially perpendicular (orthogonal) to the first directional path. By the movement of the shutter, the shutter can be configured to modulate the ultrasonic acoustic signal such that an audio signal can be generated. The shutter can be adapted to move at a second frequency along the second directional path. The generated audio signal from the shutter has a frequency which is substantially equal to the difference between the first frequency and the second frequency.

In some examples, the shutter may be implemented as a comb drive actuator. The comb drive actuator may include a moving comb and a static comb. A first signal may be applied to the shutter by a controller to initiate the movement of the comb drive actuator. The shutter may further include a spring configured to push the moving comb back to its original position. The application of the first signal and the force of the spring can thus be adapted to control movement of the shutter in a backwards and forwards motion along the second directional path.

In some examples, the membrane may be implemented as a capacitive micromachined ultrasonic transducer. A second signal may be applied to the membrane by the controller. The membrane can be oscillated along the first directional path in response to the application of the second signal through the electrostatic effect.

The shutter may move along the second directional path between a first position and a second position. The distance between the first position and the second position can be substantially equal to a distance between two adjacent openings of the first set of openings on the blind.

The shutter may also include a second set of openings. When the shutter is at the first position, the first set of openings can be aligned with the second set of openings. When the shutter is at the second position, the first set of openings are no longer aligned with the second set of openings. The relationship and orientation of the first set of openings relative to the second set of openings will be further described below.

In some embodiments, suppose the membrane is driven by an electric signal that oscillates at a frequency Ω and hence moves at Cos(2pi*Ωt). Suppose further that this electric signal has a portion that is derived from an audio signal A(t). The acoustic signal, which corresponds to the acoustic pressure related to the acceleration of the membrane, may be characterized as:

$$S(t)=\mathrm{Cos}(\Omega t)(A''(t)+1) \tag{1}$$

Where A"(t) is the second derivative of A(t) in relation to time. If B=A", then equation (1) in the frequency domain may be characterized as:

$$S(f)=\tfrac{1}{2}*[B(f-\Omega)+B(f+C)+\mathrm{delta}(f-\Omega)+\mathrm{delta}(f+\Omega)] \tag{2}$$

Where B(f) is the spectrum of the audio signal and delta(f) is the Dirac delta function.

Suppose we apply to this S(f) a shutter also oscillating at frequency Ω, then in time domain, the mathematical relationship may be characterized as:

$$S(t)=\mathrm{Cos}^2(\Omega t)(A''(t)+1) \tag{3}$$

And in frequency domain, the mathematical relationship may be characterized as:

$$S'(f)=\tfrac{1}{4}*[B(f-2\Omega)+B(f+2\Omega)+2B(f)+\mathrm{delta}(f)+\mathrm{delta}(f-2\Omega)+\mathrm{delta}(f+2\Omega)] \tag{4}$$

In some other embodiments, a speaker array may include at least two speaker devices set forth above. For example, the speaker array may include a first speaker device and a second speaker device. The first speaker device can include a first membrane and a first shutter. The second speaker device can include a second membrane and a second shutter. The first membrane can be configured to oscillate along a first directional path and at a first frequency effective to generate a first ultrasonic acoustic signal. The first shutter can be positioned above the first membrane and configured to modulate the frequency of the first ultrasonic acoustic signal effective to generate a first audio signal. The second membrane can be configured to oscillate along the first directional path and at a second frequency effective to generate a second ultrasonic acoustic signal. The second shutter can be positioned above the second membrane and configured to modulate the frequency of the second ultrasonic acoustic signal effective to generate a second audio signal. In some examples, the first frequency and the second frequency may be substantially the same.

The first shutter may be configured to move at a third frequency along a second directional path which is substantially perpendicular (e.g., orthogonal) to the first directional path. The second shutter may be configured to move at a fourth frequency along the second directional path. The third frequency and the fourth frequency may be substantially the same or different from one another. While the first shutter can be adapted to cover the top of the first speaker device, the second shutter may be simultaneously adapted to cover the top of the second speaker device. In some examples, while the first shutter can be adapted to cover the top of the first speaker device, the second shutter may be simultaneously adapted to reveal an opening at the top of the second speaker device.

In some other embodiments, a method for generating an audio signal includes selectively oscillating a membrane along a first directional path and at a first frequency effective to generate an ultrasonic acoustic signal and selectively moving a shutter positioned above the membrane to modulate the ultrasonic acoustic signal effective and generate the audio signal.

The shutter may be moved along a second directional path that is substantially perpendicular (e.g., normal or orthogonal) to the first directional path at a second frequency between a first position and a second position. The difference between the first frequency and the second frequency may be substantially equal to the frequency of the audio signal.

FIG. 1A is a cross sectional view of an illustrative embodiment of speaker device 100 arranged in accordance with at least some embodiments of the present disclosure. Speaker device 100 includes shutter 101, blind 103, membrane 105, substrate 107, controller 109, and spacers 111. Speaker device 100 may be a micro electro mechanical system (MEMS) and pico-sized. Therefore, speaker device 100 may be suitable for mobile devices because of its compact size. Substrate 107 can be a silicon substrate of a micro electro mechanical system. Spacers 111 can be configured to separate shutter 101, blind 103, membrane 105, and substrate 107.

Membrane 105 can be electrically coupled to controller 109. Controller 109 can be configured to apply a first signal 115 to membrane 105. In response to first signal 115, membrane 105 can oscillate along a directional path 190 effective to generate ultrasonic acoustic wave 117. Ultrasonic acoustic wave 117 may propagate along the directional path 190 from membrane 105 towards blind 103 and shutter 101.

In some examples, first alternating signal 115 may be a voltage or a current that alternates according to a first frequency. In some other examples, first alternating signal 115 may be some other variety of periodically changing signal such as a current or voltage that may be sinusoidal, pulsed, ramped, triangular, linearly changing, non-linearly changing, or some combination thereof. The oscillation frequency of membrane 105 can be substantially proportional to the frequency of first alternating signal 115. Therefore, by applying different alternating signals 115, controller 109 can control the oscillation frequency of membrane 105.

Blind 103 can be positioned above membrane 105 and below shutter 101. Blind 103 can include a first set of rectangular openings (not shown). Ultrasonic acoustic wave 117 passes through the openings of blind 103 through to shutter 101.

Shutter 101 is electrically coupled to controller 109. Controller 109 can be configured to apply a second signal 113 to shutter 101. In response to second signal 113, shutter 101 can moves along a directional path 192 between a first position and a second position. Shutter 101 includes a second set of openings (not shown). The relationship and orientation of the first set of openings relative to the second set of openings will be further described below.

Figure 1B:
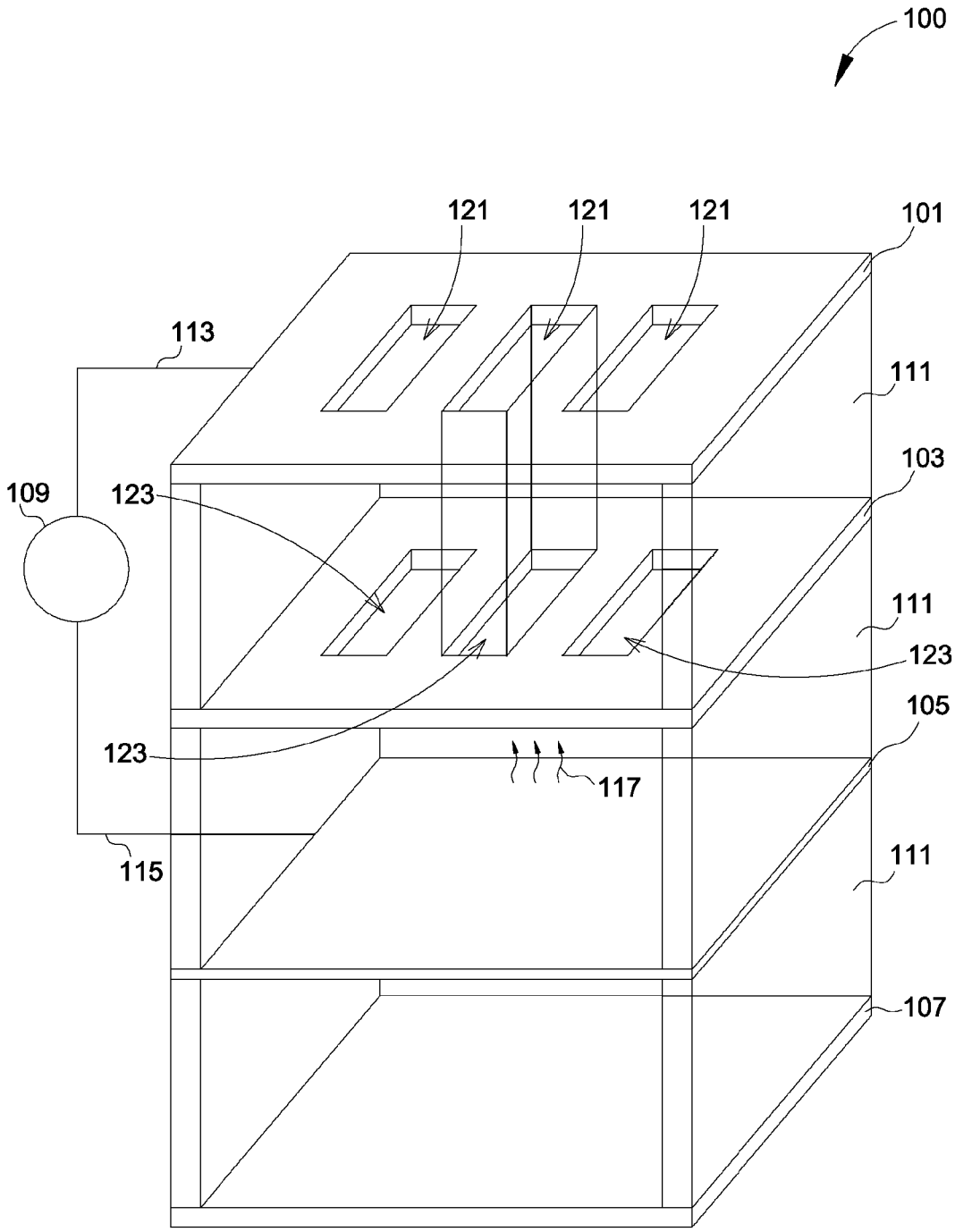
FIG. 1B is a perspective view of an illustrative embodiment of a speaker.

FIG. 1B is a perspective view of an illustrative embodiment of speaker device 100 set forth above and arranged in accordance with at least some embodiments of the present disclosure. Shutter 101 includes a second set of openings 121. When shutter 101 is at a first position, as shown in FIG. 1B, the second set of openings 121 is in alignment (shown with dotted lines) with the first set of openings 123 of blind 103. Ultrasonic acoustic signal 117 could as a result directly pass through blind 103 and shutter 101 through the first set of openings 123 and the second set of openings 121, respectively.

FIG. 10 is another perspective view of an illustrative embodiment of speaker device 100 set forth above and in accordance with at least some embodiments of the present disclosure. When shutter 101 is at a second position, as shown in FIG. 10, the displacement between the first position and the second position is given as displacement $d_1$. The displacement $d_1$ may be equal to the distance $d_2$ between two adjacent openings of the first set of openings 123.

Figure 2:
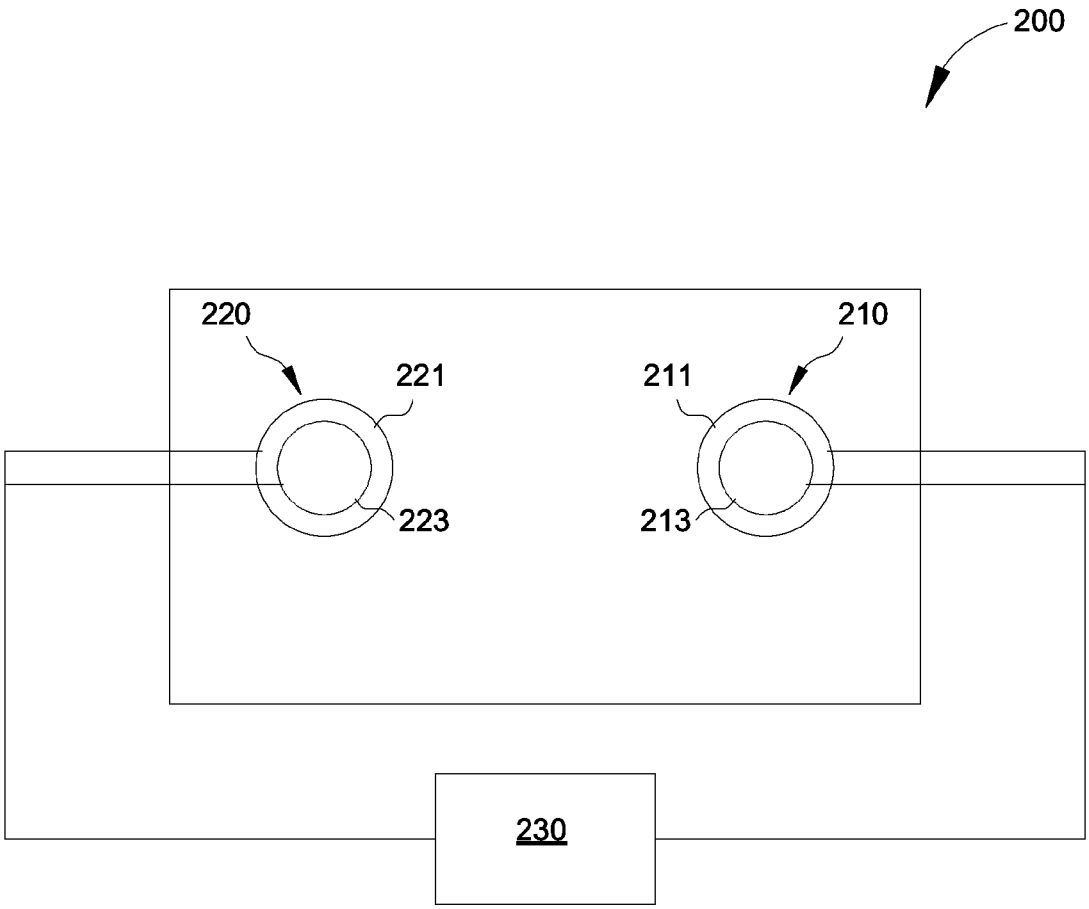
FIG. 2 is a top view of an illustrative embodiment of a speaker array.

FIG. 2 is a top view of an illustrative embodiment of speaker array 200, arranged in accordance with at least some embodiments of the present disclosure. Speaker array 200 can include a first speaker device 210 and a second speaker device 220. First speaker device 210 can include a first shutter 211 and a first membrane 213. First shutter 211 and first membrane 213 are both electrically coupled to controller 230. Controller 230 can be configured to apply a first signal to first shutter 211 and a second signal to first membrane 213. As set forth above, the moving frequency of first shutter 211 and the oscillation frequency of first membrane 213 can be associated with the first signal and the second signal, respectively. A first audio signal can be generated based on the movement of the first shutter 211 and the oscillating membrane 213.

Second speaker device 220 can include a second shutter 221 and a second membrane 223. Second shutter 221 and second membrane 223 are both electrically coupled to controller 230. Controller 230 can be configured to apply a third signal to second shutter 221 and a fourth signal to second membrane 223. As set forth above, the moving frequency of second shutter 221 and the oscillation frequency of second membrane 223 are associated with the third signal and the fourth signal, respectively. A second audio signal can be generated based on the movement of the second shutter 221 and the oscillating membrane 223.

When the moving frequencies of first shutter 211 and second shutter 221, and the oscillation frequencies of first membrane 213 and second membrane 223 are substantially the same, the first audio signal can be generated by first speaker device 210 and the second audio signal can be generated by second speaker device 220 have substantially the same frequency. When the moving frequencies of first shutter 211 and second shutter 221 are different, or the oscillation frequencies of first membrane 213 and second membrane 223 are different, the first audio signal generated by first speaker 210 and the second audio signal generated by second speaker 220 have substantially different frequencies. Generating different audio signals from various elements in the speaker array can be used for generating psychoacoustic effects creating the illusion of novel sound location or unique temporal effects in the acoustic signal.

Figure 3:
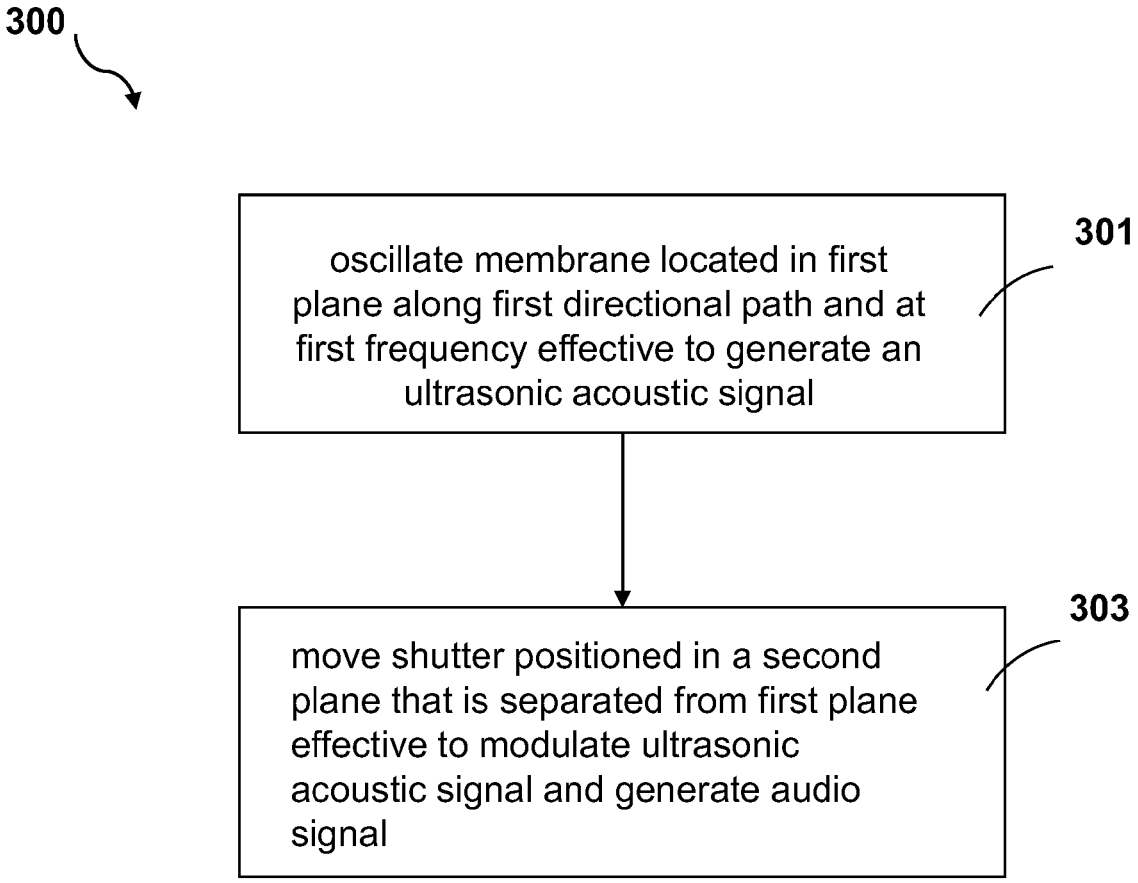
FIG. 3 is a flow chart of an illustrative embodiment of a method for generating an audio signal.

FIG. 3 is a flow chart of an illustrative embodiment of method 300 for generating an audio signal in accordance with at least some embodiments of the present disclosure. Method 300 may begin at block 301.

At block 301, example method 300 includes oscillating a membrane located in a first plane along a first directional path and at a first frequency effective to generate an ultrasonic acoustic signal. Method 300 may further include applying a first signal to the membrane to initiate the oscillation. The method may continue at block 303.

At block 303, the example method 300 includes moving a shutter positioned in a second plane that is separated from the first plane effective to modulate the ultrasonic acoustic signal and generate the audio signal. The shutter may move along a second directional path substantially perpendicular to the first directional path and at a second frequency. The shutter may have a displacement along the second directional path. The displacement will typically not be greater than a distance between two adjacent openings on the blind. The frequency of the generated audio signal may be substantially equal to the difference between the first frequency and the second frequency.

Figure 4:
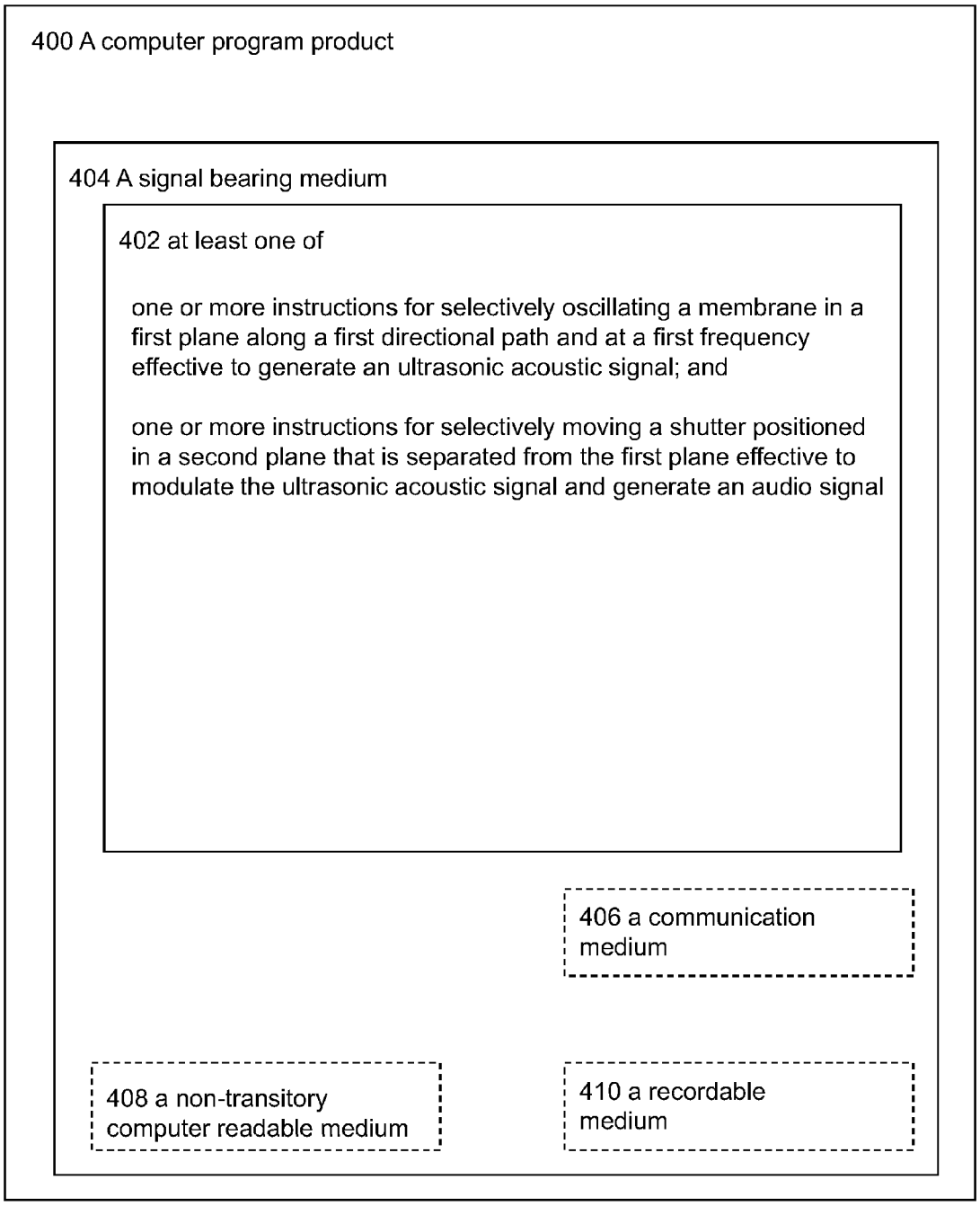
FIG. 4 shows a block diagram illustrating a computer program product that is arranged for generating an audio signal.

FIG. 4 shows a block diagram illustrating a computer program product 400 that is arranged for generating an audio signal in accordance with at least some embodiments of the present disclosure. Computer program product 400 may include signal bearing medium 404, which may include one or more sets of executable instructions 402 that, when executed by, for example, a processor of a computing device, may provide at least the functionality described above and illustrated in FIG. 3.

In some implementations, signal bearing medium 404 may encompass non-transitory computer readable medium 408, such as, but not limited to, a hard disk drive, a Compact Disc (CD), a Digital Versatile Disk (DVD), a digital tape, memory, etc. In some implementations, signal bearing medium 404 may encompass recordable medium 410, such as, but not limited to, memory, read/write (R/W) CDs, R/W DVDs, etc. In some implementations, signal bearing medium 404 may encompass communications medium 406, such as, but not limited to, a digital and/or an analog communication medium (e.g., a fiber optic cable, a waveguide, a wired communications link, a wireless communication link, etc.) Computer program product 400 may also be recorded in non-transitory computer readable medium 408 or another similar recordable medium 410.

Figure 5:
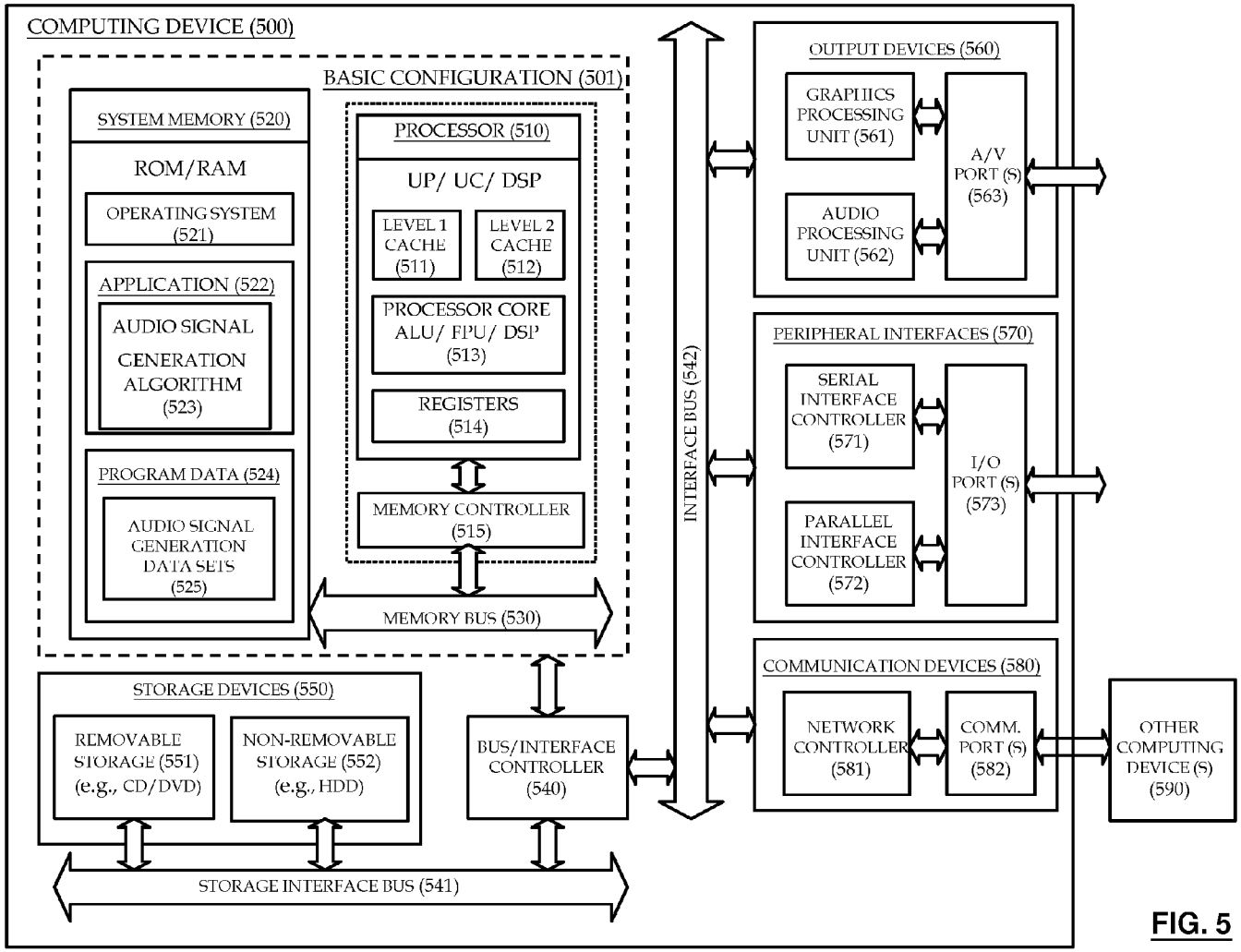
FIG. 5 shows a block diagram of an illustrative embodiment of a computing device that is arranged for generating an audio signal, all arranged in accordance with at least some embodiments of the present disclosure.
Figure 5:
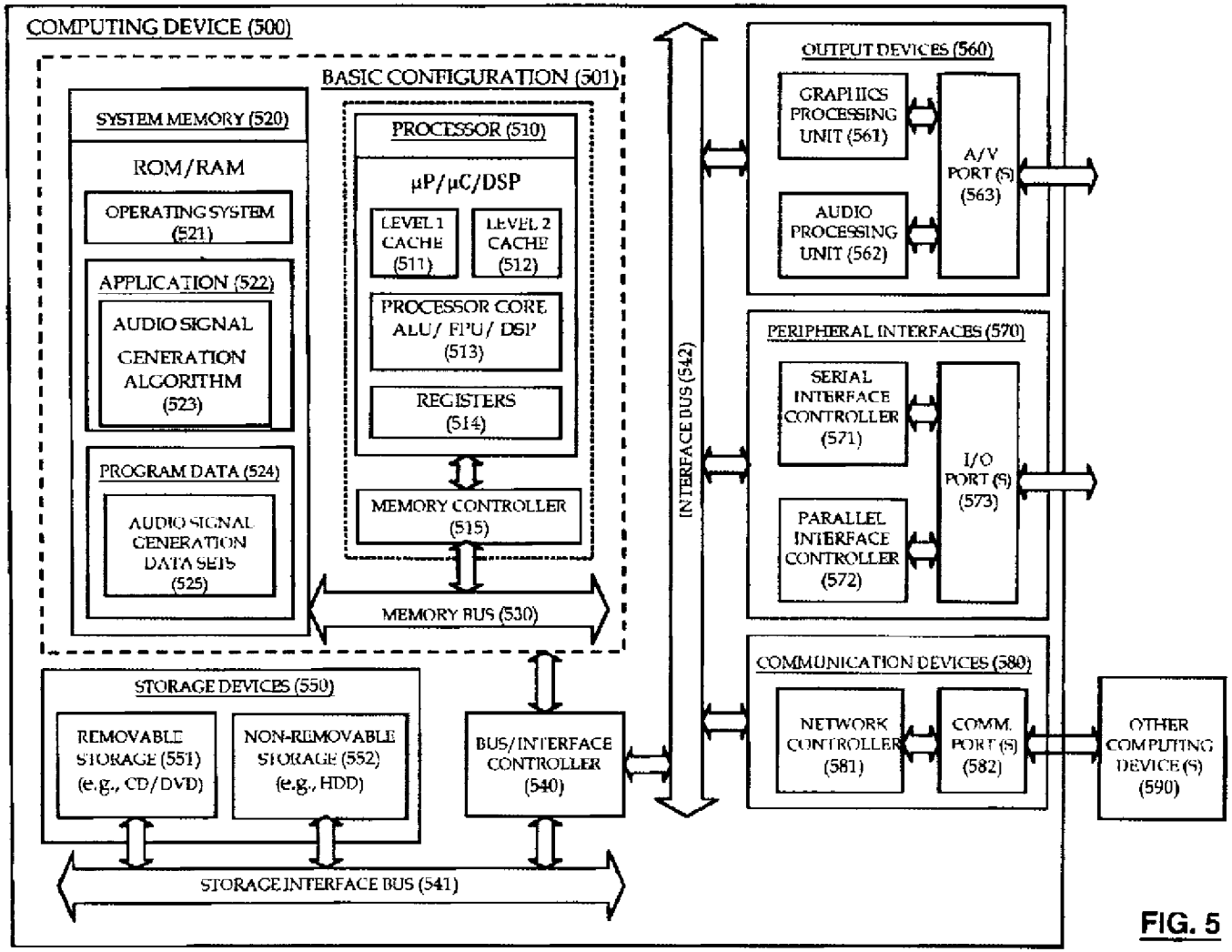

FIG. 5 shows a block diagram of an illustrative embodiment of a computing device that is arranged for generating an audio signal in accordance with at least some embodiments of the present disclosure. In a very basic configuration 501, computing device 500 typically includes one or more processors 510 and a system memory 520. A memory bus 530 may be used for communicating between processor 510 and system memory 520.

Depending on the desired configuration, processor 510 may be of any type including but not limited to a microprocessor (μP), a microcontroller (μC), a digital signal processor (DSP), or any combination thereof. Processor 510 may include one more levels of caching, such as a level one cache 511 and a level two cache 512, a processor core 513, and registers 514. An example processor core 513 may include an arithmetic logic unit (ALU), a floating point unit (FPU), a digital signal processing core (DSP Core), or any combination thereof. An example memory controller 515 may also be used with processor 510, or in some implementations memory controller 515 may be an internal part of processor 510.

Depending on the desired configuration, system memory 520 may be of any type including but not limited to volatile memory (such as RAM), non-volatile memory (such as ROM, flash memory, etc.) or any combination thereof. System memory 520 may include an operating system 521, one or more applications 522, and program data 524. In some embodiments, application 522 may include an audio signal generation algorithm 523 that is arranged to perform the functions as described herein including those described with respect to the steps 301 and 303 of the method 300 of FIG. 3. Program data 524 may include audio signal generation data sets 525 that may be useful for the operation of audio signal generation algorithm 523 as will be further described below. In some embodiments, the audio signal generation data sets 525 may include, without limitation, a first signal level and a second signal level which oscillates the membrane and moves the shutter, respectively. In some embodiments, application 522 may be arranged to operate with program data 524 on operating system 521 such that implementations of selecting preferred data set may be provided as described herein. This described basic configuration 501 is illustrated in FIG. 5 by those components within the inner dashed line.

In some other embodiments, application 522 may include audio signal generation algorithm 523 that is arranged to perform the functions as described herein including those described with respect to the steps 301 and 303 of the method 300 of FIG. 3.

Computing device 500 may have additional features or functionality, and additional interfaces to facilitate communications between basic configuration 501 and any required devices and interfaces. For example, a bus/interface controller 540 may be used to facilitate communications between basic configuration 501 and one or more data storage devices 550 via a storage interface bus 541. Data storage devices 550 may be removable storage devices 551, non-removable storage devices 552, or a combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), and tape drives to name a few. Example computer storage media may include volatile and nonvolatile, removable and non-removable media implemented in any method or technology for storage of information, such as computer readable instructions, data structures, program modules, or other data.

System memory 520, removable storage devices 551 and non-removable storage devices 552 are examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which may be used to store the desired information and which may be accessed by computing device 500. Any such computer storage media may be part of computing device 500.

Computing device 500 may also include an interface bus 542 for facilitating communication from various interface devices (e.g., output devices 560, peripheral interfaces 570, and communication devices 580) to basic configuration 501 via bus/interface controller 540. Example output devices 560 include a graphics processing unit 561 and an audio processing unit 562, which may be configured to communicate to various external devices such as a display or speakers via one or more A/V ports 563. Example peripheral interfaces 570 include a serial interface controller 571 or a parallel interface controller 572, which may be configured to communicate with external devices such as input devices (e.g., keyboard, mouse, pen, voice input device, touch input device, etc.) or other peripheral devices (e.g., printer, scanner, etc.) via one or more I/O ports 573. An example communication device 580 includes a network controller 581, which may be arranged to facilitate communications with one or more other computing devices 590 over a network communication link via one or more communication ports 582. In some embodiments, the other computing devices 590 may include other applications, which may be operated based on the results of the application 522.

The network communication link may be one example of a communication media. Communication media may typically be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), microwave, infrared (IR) and other wireless media. The term computer readable media as used herein may include both storage media and communication media.

Computing device 500 may be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 500 may also be implemented as a personal computer including both laptop computer and non-laptop computer configurations.

There is little distinction left between hardware and software implementations of aspects of systems; the use of hardware or software is generally (but not always, in that in certain contexts the choice between hardware and software can become significant) a design choice representing cost versus efficiency tradeoffs. There are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and/or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Versatile Disk (DVD), a digital tape, a computer memory, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to disclosures containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

I claim:

1. A speaker device, comprising:

a membrane positioned in a first plane, wherein the membrane is configured to oscillate along a first directional path and at a first frequency effective to generate an ultrasonic acoustic signal; and a shutter positioned in a second plane that is substantially separated from the first plane, wherein the shutter is configured to modulate the ultrasonic acoustic signal such that an audio signal is generated.

2. The speaker device of claim 1, wherein the shutter is configured effective to move along a second directional path substantially perpendicular to the first directional path.

3. The speaker device of claim 2, wherein the shutter is configured to move along the second directional path at a second frequency, wherein the frequency of the audio signal is substantially equal to the difference between the first frequency and the second frequency.

4. The speaker device of claim 2, further comprising a blind positioned in a third plane located between the membrane in the first plane and the shutter in the second plane.

5. The speaker device of claim 4, wherein the membrane, the blind, and the shutter are positioned in planes that are substantially parallel to each other.

6. The speaker device of claim 4, wherein the shutter is configured to move along the second directional path between a first position and a second position defining a displacement along the second directional path, wherein the displacement is substantially equal to a distance between two adjacent openings of the first set of openings of the blind.

7. The speaker device of claim 6, wherein the shutter includes a second set of openings.

8. The speaker device of claim 7, wherein when the shutter is at the first position, the first set of openings are substantially aligned with the second set of openings.

9. The speaker device of claim 2, further comprising a blind positioned in a third plane that is substantially separated from the first plane and the second plane.

10. The speaker device of claim 1, wherein the membrane and the shutter comprise an individual speaker from an array of speakers in the speaker device.

11. A method for generating an audio signal, comprising:

selectively oscillating a membrane located in a first plane along a first directional path and at a first frequency effective to generate an ultrasonic acoustic signal; and selectively moving a shutter positioned in a second plane that is separated from the first plane effective to modulate the ultrasonic acoustic signal and generate the audio signal.

12. The method of claim 11, wherein moving the shutter further comprises moving the shutter along a second directional path substantially perpendicular to the first directional path.

13. The method of claim 12, further comprising moving the shutter along the second directional path at a second frequency, wherein the frequency of the audio signal is substantially equal to the difference between the first frequency and the second frequency.

14. The method of claim 12, wherein moving the shutter along the second directional path further comprises moving the shutter between a first position and a second position.

15. The method of claim 14, wherein a displacement between the first position and the second position is associated with a distance between two adjacent openings on the blind.

16. A speaker array, comprising:

a first speaker device, comprising a first membrane positioned in a first plane, wherein the first membrane is configured to oscillate along a first directional path and at a first frequency effective to generate a first ultrasonic acoustic signal; and a first shutter positioned in a second plane that is substantially separated from the first plane, wherein the first shutter is configured to modulate the first ultrasonic acoustic signal such that a first audio signal is generated; and a second speaker device, comprising a second membrane positioned in the first plane, wherein the second membrane is configured to oscillate along the first directional path and at a second frequency effective to generate a second ultrasonic acoustic signal; and a second shutter positioned in the second plane, wherein the second shutter is configured to modulate the second ultrasonic acoustic signal such that a second audio signal is generated.

17. The speaker array of claim 16, wherein the first frequency and the second frequency are substantially the same.

18. The speaker array of claim 16, wherein the first shutter is configured to move at a third frequency along a second directional path substantially perpendicular to the first directional path, the second shutter is configured to move at a fourth frequency along the second directional path.

19. The speaker array of claim 18, wherein the third frequency and the fourth frequency are substantially the same.

20. The speaker array of claim 19, wherein the first shutter is simultaneously adapted to cover the top of the first speaker device, while the second shutter is adapted to cover the top of the second speaker device.

21. The speaker array of claim 19, wherein the first shutter is simultaneously adapted to cover the top of the first speaker device, while the second shutter is adapted to reveal an opening at the top of the second speaker device.

* * * * *

UNITED STATES PATENT AND TRADEMARK OFFICE

CERTIFICATE OF CORRECTION

PATENT NO. : 8,861,752 B2
APPLICATION NO. : 13/390337
DATED : October 14, 2014
INVENTOR(S) : Margalit It is certified that error appears in the above-identified patent and that said Letters Patent is hereby corrected as shown below:

In the Drawings

In Fig. 5, Sheet 7 of 7, delete "UP/UC/DSP" and insert -- μP/μC/DSP --, as in the attached sheet, therefor.

In the Specification

Figure 1C:
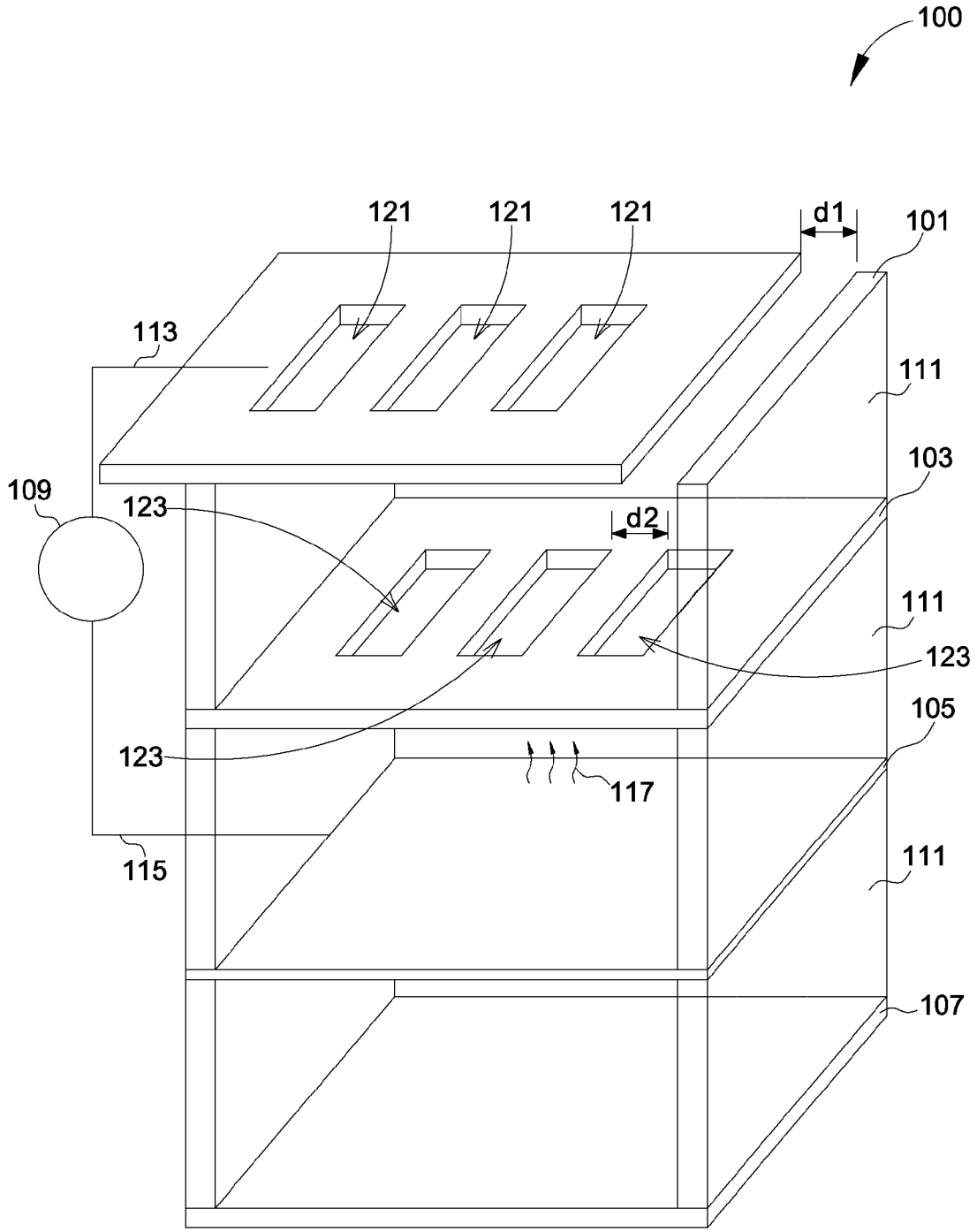
FIG. 1C is another perspective view of an illustrative embodiment of a speaker.

In Column 5, Line 25, delete "FIG. 10" and insert -- FIG. 1C --, therefor.

In Column 5, Line 29, delete "FIG. 10," and insert -- FIG. 1C, --, therefor.

In the Claims

In Column 11, Line 18, in Claim 2, delete "configured effective" and insert -- configured --, therefor.

Signed and Sealed this
Twenty-fourth Day of March, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,861,752 B2
APPLICATION NO. : 13/390337
DATED : October 14, 2014
INVENTOR(S) : Margalit It is certified that error appears in the above-identified patent and that said Letters Patent is hereby corrected as shown below:

In the Claims

In Column 11, Line 36, in Claim 6, delete “the first set of openings” and insert -- a first set of openings --, therefor.

In Column 12, Line 48, in Claim 20, delete “the top” and insert -- a top --, therefor.

In Column 12, Line 49, in Claim 20, delete “the top” and insert -- a top --, therefor.

In Column 12, Line 52, in Claim 21, delete “the top” and insert -- a top --, therefor.

In Column 12, Line 54, in Claim 21, delete “the top” and insert -- a top --, therefor.

Signed and Sealed this
Eleventh Day of August, 2015

Michelle K. Lee

Michelle K. Lee
*Director of the United States Patent and Trademark Office*